US006557368B1

(12) United States Patent
DeMars

(10) Patent No.: US 6,557,368 B1
(45) Date of Patent: May 6, 2003

(54) CONFECTION PARTY SYSTEM

(76) Inventor: Robert A. DeMars, 23221 Ladrillo St., Woodland Hills, CA (US) 91367

( * ) Notice: Subject to any disclaimer, the term of this patent is extended or adjusted under 35 U.S.C. 154(b) by 0 days.

(21) Appl. No.: 10/016,936

(22) Filed: Dec. 13, 2001

(51) Int. Cl.[7] ..... F25D 3/08
(52) U.S. Cl. ..... 62/457.2; 62/457.6; 62/530
(58) Field of Search ..... 62/457.2, 457.6, 62/457.7, 371, 530

(56) References Cited

U.S. PATENT DOCUMENTS 2,030,899 A * 2/1936 Scurlock ..... 211/77
3,972,419 A * 8/1976 Short ..... 211/78
D286,124 S * 10/1986 Dempsey ..... D7/501
4,989,419 A * 2/1991 Brando et al. ..... 62/457.2
6,186,055 B1 * 2/2001 DeMars et al. ..... 99/340

* cited by examiner

*Primary Examiner*—William C. Doerrler
(74) *Attorney, Agent, or Firm*—Cislo & Thomas LLP

(57) ABSTRACT

A food dispensing modular assembly comprising a turn table which supports a plurality of containers for holding food accompaniments such as toppings, fixings and the like for easy dispensing and for food needing refrigeration, such as ice cream over a longer period of time during party celebrations and the like.

14 Claims, 5 Drawing Sheets

CONFECTION PARTY SYSTEM

BACKGROUND OF THE INVENTION

1. Field of the Invention

This invention relates to a turntable or lazy susan-type appliance which provides a modular system for dispensing food and attendant fixings such as toppings, nuts and the like and which presents an aesthetic accompaniment to any party or celebration.

2. Description of the Related Art

While the use of lazy susans or rotatable trays themselves are relatively known in the art and have been used for long periods of time, particularly in Chinese restaurants, as far as known none have been associated with a various food, including a yogurt, ice cream, etc. food server. While U.S. Pat. No. 6,186,055 B1, of which the current inventor is a co-inventor therein, describes a turntable cooking and serving appliance, none of the known prior art discloses or teaches a modular system for serving food and attendant toppings, syrups or the like that acts as an accompaniment to the food.

The problem with serving cooled foods at party functions or circumstances where there are a plurality of people has always been to be able to maintain the food, especially if a frozen confection, in a servable condition in proximity to the toppings and the fixings that would go along with it. The prior art, as far as known, has never combined a modular system, exposed to the ambient, that would enable ice cream to be served and held at an adequate temperature for some period of time to allow service therefrom of ice cream, for example, and the attendant toppings that would go along with it and still allow for easy clean-up after the service has been completed.

SUMMARY OF THE INVENTION

It is an object of the invention to provide a relatively low maintenance, easily manufactured turntable-type modular assemblage for the keeping and dispensing of confections such as ice cream, frozen yogurt, etc., and party fixings that would normally be associated for serving, for example, with ice cream.

It is another important object of the invention to provide a modular assemblage of economic construction that lends itself to be utilized at gatherings comprising parties and celebrations.

It is another object of the invention to provide a modular turntable device that is capable of holding and maintaining cooled foods at appropriate temperatures and allows for the easy dispensing thereof along with associated accompaniments.

It is still another important object of the invention to provide an easily constructed, easily cleanable confection dispensing assembly which is easy to use and provides for easy clean-up after use.

It is still another important specific object of the invention to provide an insulated frozen confection holder that may be stored in the freezer after which the same may be removed therefrom and into which a frozen confection container may be placed and by reason of the insulated material maintains the frozen confection for a time period to allow serving thereof at ambient temperatures and wherein the frozen confection container is associated with a plurality and array of containers from which accompaniments such as toppings and fixings and the like may be dispensed.

It is still a more important, specific object of the invention to provide an ice cream container holder which is capable of acting as a cooling device and wherein it is modularly assembled into a serving assembly which is easy to use, easy to clean up and allows for use by a plurality of individuals regardless of where the assembly is placed.

In its most basic form, the invention is directed to frozen confection keeping and serving devices comprising a base, an insulating container mounted on the base wherein the insulating container includes a cooling means which most generally takes the form of a gel or other substance that is capable of being frozen so as to keep the frozen confection therein at appropriate temperatures, and wherein an annular compartment surrounds the insulating container and is located adjacent to the insulating-container and further has a ring mounted within the annular compartment so as to better stabilize and hold a frozen confection carton of the usual gallon type in a secure relationship within the insulating container and which further includes a bearing assembly located between the ring and the annular compartment, with the ring being freely rotatable relative to the base section and the insulating container, much like a lazy susan of the ubiquitous-type provides. A plurality of trays or containers are located within the annular compartment resting on the ring and are rotatable therewith with each of the trays or containers being adapted to contain accompaniments such as, for example, ice cream fixings or toppings.

These and other objects of the invention will become apparent from the hereinafter following commentary taken in conjunction with the drawings.

DETAILED DESCRIPTION OF THE PREFERRED EMBODIMENT(S)

Figure 1:
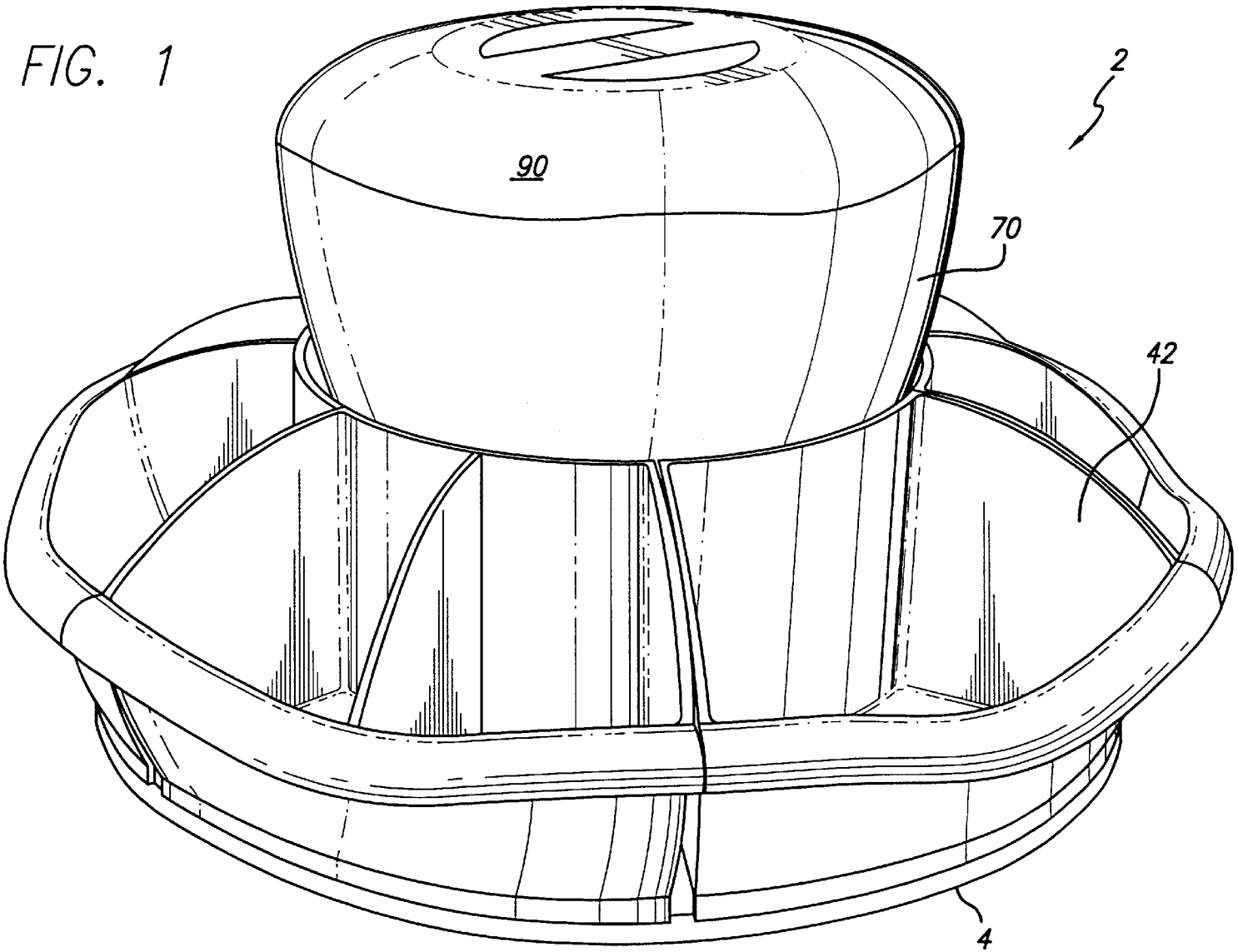
FIG. 1 is a perspective view illustrating the modular assembly of the invention.
Figure 2:
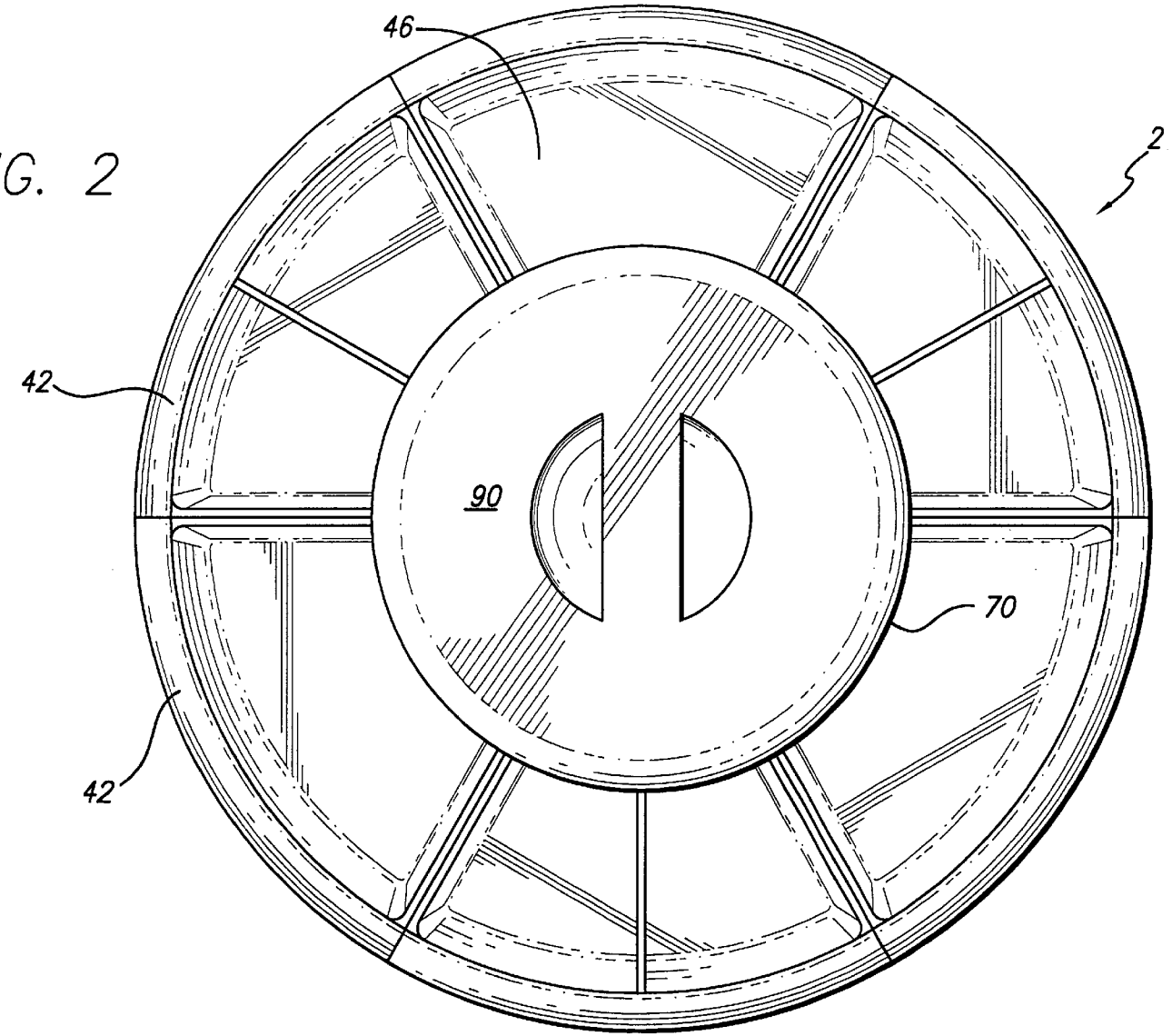
FIG. 2 is a top view of the assembly depicted in FIG. 1.

The detailed description set forth below in connection with the appended drawings is intended as a description of presently-preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Referring to the drawings wherein like numerals of reference designate like elements throughout, it will be noted that the modular assemblage or system 2 of the invention comprises a lazy susan base 4, in this instance of molded plastic, having an annular configuration with an interior recess 6. As is usual, the lazy susan base 4 has a central rotatable means 10 supported for rotative relationship relative to lazy susan base 4 by means of ball bearings 12. Lazy susan base 4 has in this particular instance depending circumferential flange 14 to provide an aesthetic appearance to the overall modular assemblage 2.

It is clear that the flange 14 extends downwardly to the depth of rotatable member 10 so that anything placed on the surface 6 of lazy susan base 4 may be easily moved in rotatable fashion.

Super positioned within the recess 6 of lazy susan base 4 is congruently shaped base plate 16 having a central recess 18 with surrounding ridge 20 of a size to receive the base of the insulated cooler or container as will become apparent. The base plate 16 has a circumferential configuration which is congruent to the recess 6 of lazy susan base 4 so that the same may nest or mate therein. The underside of base plate 16, and more specifically the circumferential ridge 22, is provided with spaced rubber feet 24 so as to provide traction between base plate 16 and lazy susan base 4 so that base plate 16 is rotatable with respect to lazy susan base 4 and rotates therewith. Annular ring member 26 is congruently configured to the outer ring portion 28 of base plate 16 and is adapted to mate or seat thereover in congruent relationship therewith and is provided with aperture 30 which circumscribes recess 18 and acts as a guard or shield to prevent toppings and ice cream fixings and the like as will be described from fouling the base plate 16 which rests upon lazy susan base 4 and also provides a support for a plurality of containers or trays as will be described. The annular ring 26 has an interior depending flange or portion 32 that circumscribes the inner opening 30 and has an outer depending circumference 33 forming a rise or abutment surface 34 by which the trays or containers 42 may be supported therefrom, as will be more fully described.

Figure 3:
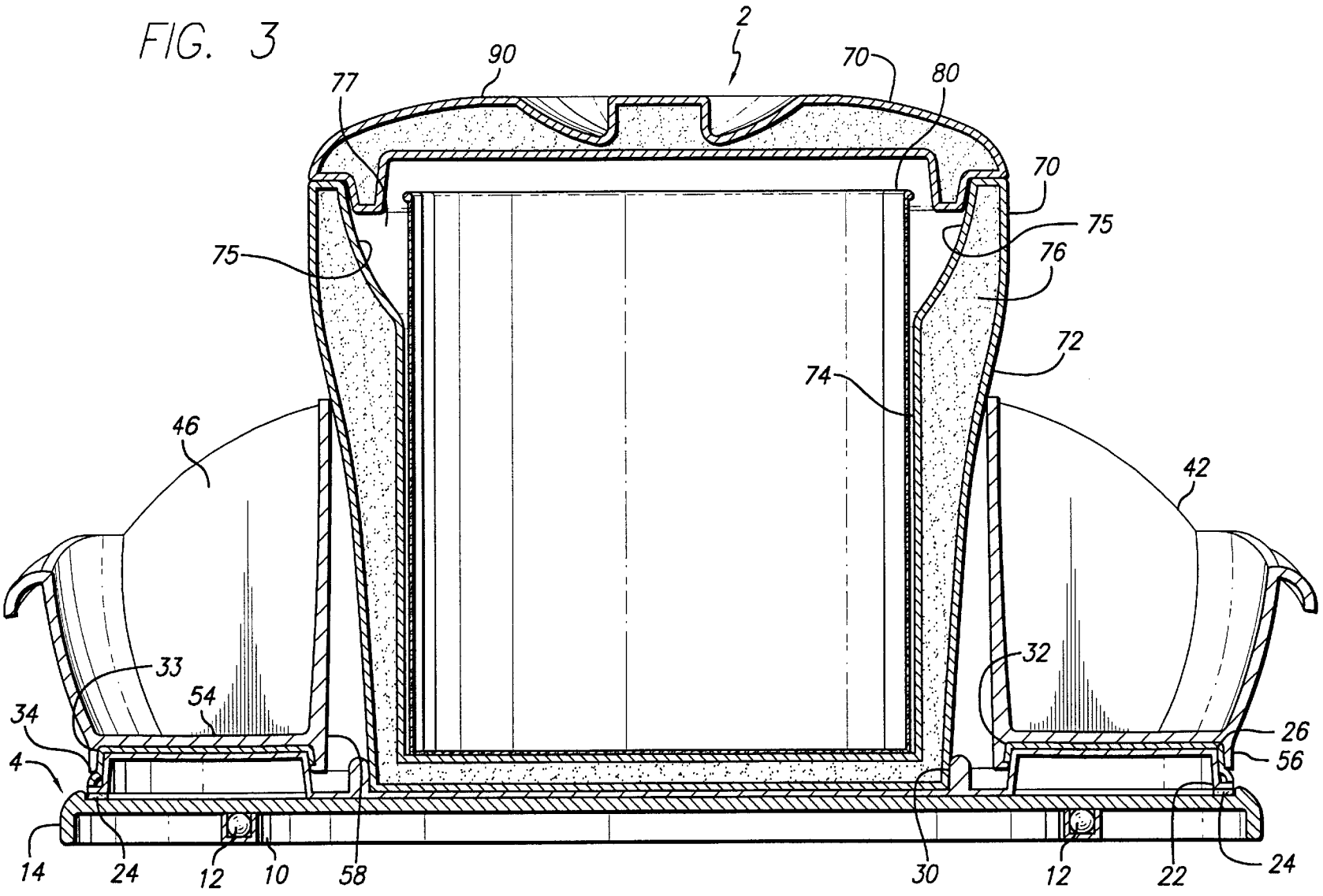
FIG. 3 is a cross-sectional view of the assembly depicted in FIG. 1 illustrating more detailed construction thereof.
Figure 4:
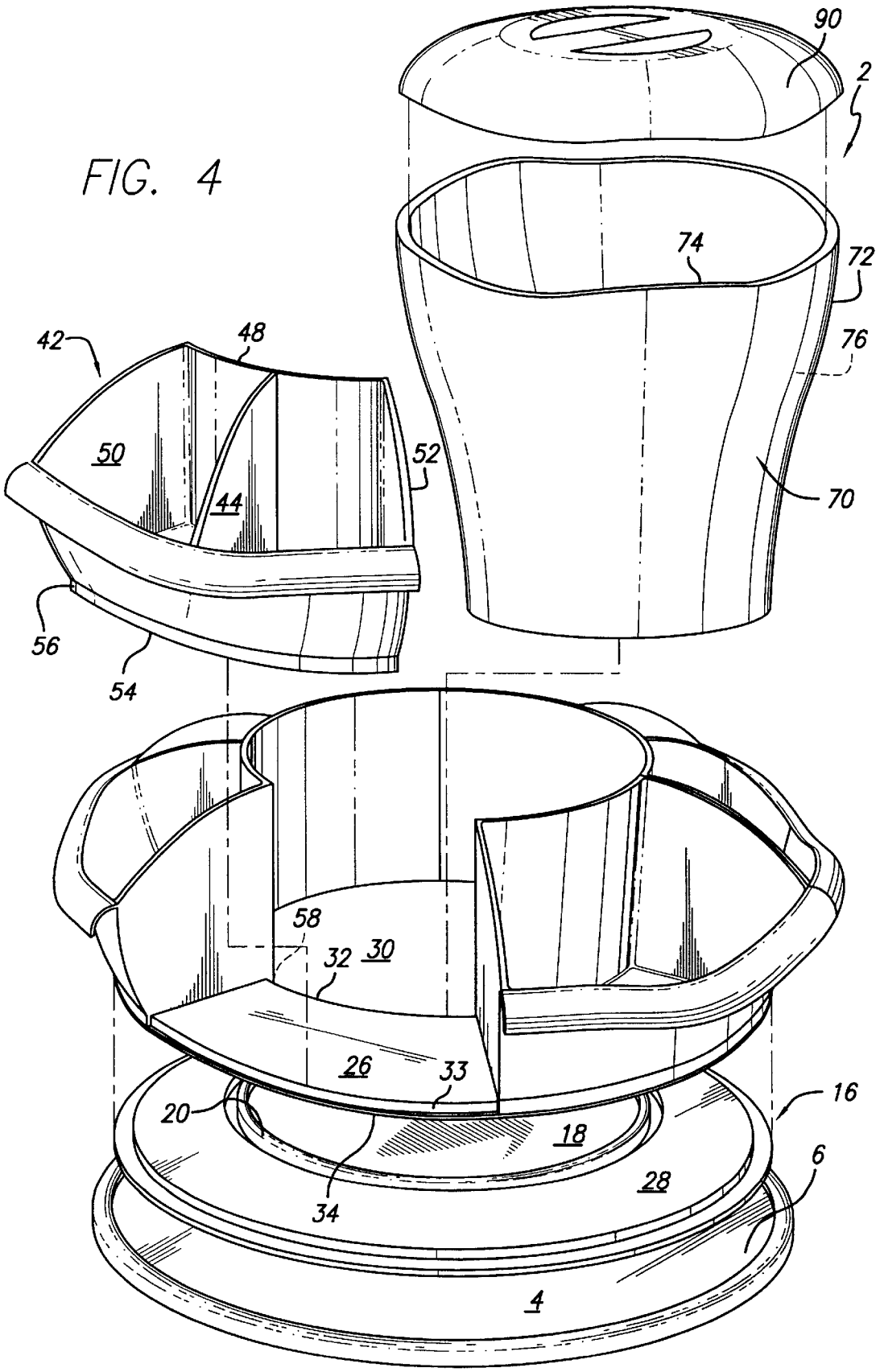
FIG. 4 is an exploded view of the modular assemblage depicted in FIG. 1 and showing more detailed construction of the invention.
Figure 5:
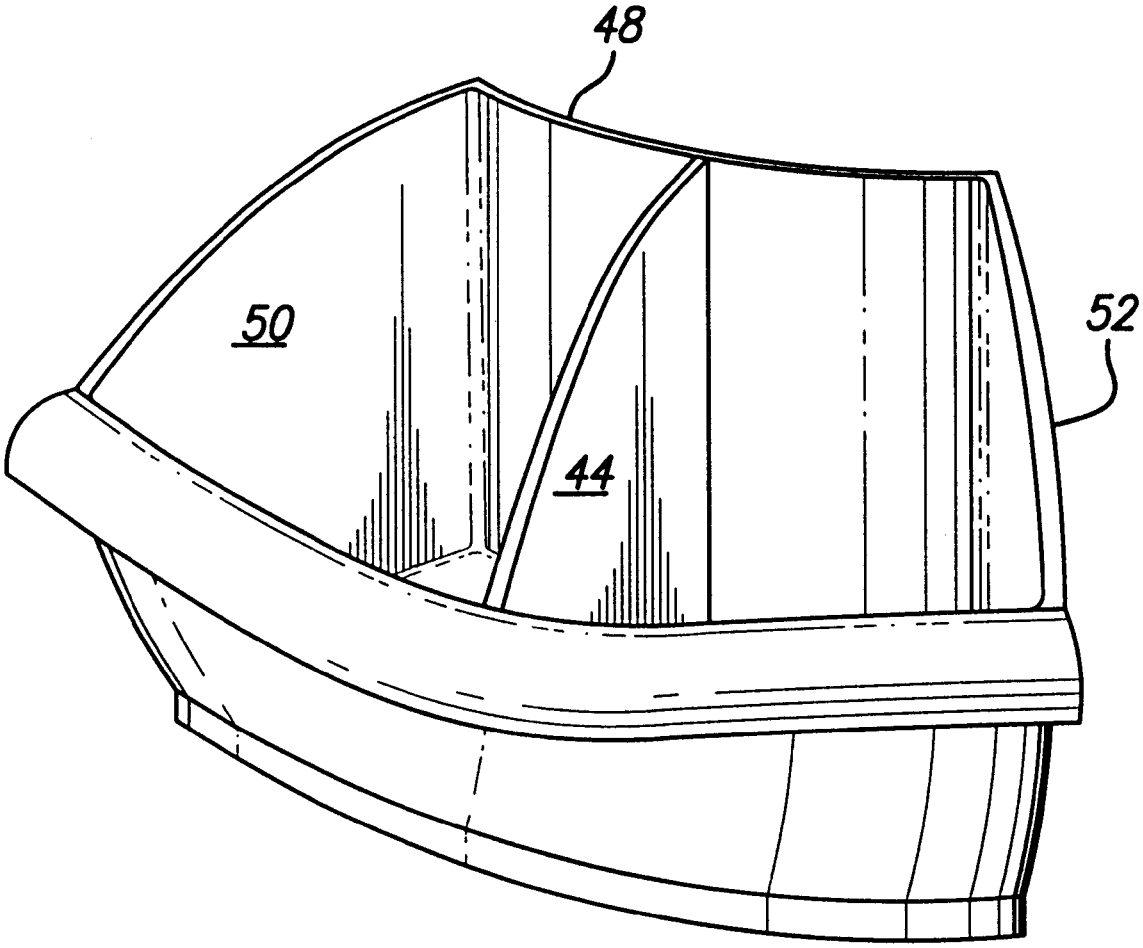
FIG. 5 in an enlarged view of one of the dispensing trays or containers of the modular assembly of the invention.

Referring to FIGS. 3, 4 and 5 it will be seen that the plurality of containers 42, which may be compartmentalized by reason of partition 44, are of aesthetic configuration and are of molded plastic as are the elements previously described for ease of manufacturing and ease of clean-up. Each of the containers 42 are configured to have an open or flowing entry or opening 46 defined by a rear curvilinear wall 48, side walls 50 and 52 with bottom wall 54. The compartments or containers 42 are configured and shaped to have depending locating wall portions 56 and 58, which engage the outer circumference 32 of ring member 26 so as to hold the individual containers 42 in secured relationship therewith and because the modular assemblage is rotatable the containers holding accompaniments such as for example ice cream fixings, syrups and the like, not shown, may be easily made accessible to people attending the celebration, party, etc. where the confection party system of the invention is utilized.

Completing the modular assemblage is aesthetically shaped insulated holder 70 in this instance having double wall construction formed by outer wall 72 and inner wall 74 forming space 76 therebetween which may contain water or freezable gel of the conventional type such that the insulated container 70 may be placed in the freezer in order to obtain the maximum cooling of the insulative material 76 prior to the device 2 of the invention being utilized. It will be noted that inner wall 74 has an inclined circumferential wall portion 75 forming space 77 so that an ice cream carton 80 may be easily removed.

It should be noted that the insulated holder 70 is of an internal volume or configuration to receive the conventional gallon-size frozen confection or ice cream carton 80 within which product, not shown, may be contained. Obviously other foods, especially homemade ice cream, may be placed directly in the interior chamber of the insulated holder 70.

Completing the modular assemblage is cover 90 of the type that may or may not have an insulative material within the wall construction thereof. However, in this particular instance the cover 90 is shown of double wall construction having a gel or water for freezing therein which gel 76 may act to keep the confection or other food, not shown, contained within the insulated container 70 at a servable consistency during the use of the confection party system 2.

Thus, in use of the modular system 2 of the invention in preparation for party dispensing of cold foods and/or ice cream for example, the container 70 with the cover 90 may be placed in the freezer for several hours or until such time as the gel or water within the double walled construction is frozen. Thereafter, the container 70 with lid 90 is removed and placed in position in the modular assembly as illustrated, for example in FIG. 3, and the gallon ice cream container placed within the insulated container 70 and the lid 90 placed thereon. Thereafter, with the plurality of containers 42 in position, a number of fixings or toppings are placed within the various compartments and suitable spoons or dispensers, not shown, placed therein. At the time of dispensing of the ice cream, the lid is removed and what is particularly pleasing of the assemblage of the invention is the fact that party goers may conveniently serve themselves by removing ice cream from the container and thereafter rotating the lazy susan-like assemblage to access and place various fixings and toppings on the ice cream in a festive manner. Because of the easy use of the ice dispenser system 2 of the invention, ice cream or other foods may be dispensed and toppings or condiments put thereon in an easy manner.

Because of the molded plastic construction, the modular assemblage 2 is of relatively low cost and of generally fault free operation. It should be understood that various modifications and changes can be made to the disclosed invention as by, for example, the elimination of the annular ring 26 which is preferable for sanitary and clean-up purposes, in which event the plurality of containers 42 may be directly positioned onto base plate 16 because of their co-acting configurations.

Additionally, while the rear wall 48 of the containers 42 has been shown as being curvilinear so as to more conform to the external surface or configuration of the insulated holder 70, it will be apparent to those of ordinary skill in the art that the containers 42 may take various shapes. Additionally, while the various elements comprising the modular assemblage 2 of the invention are being shown as being circular or annular, other polygonal shapes are contemplated and may in certain instances be preferred to those configurations and shapes shown.

All of the foregoing modifications, as well as others, will make themselves apparent to those of ordinary skill in the art and all such changes or modifications are intended to be encompassed within the scope of the appended claims.

While the present invention has been described with regards to particular embodiments, it is recognized that additional variations of the present invention may be devised without departing from the disclosed inventive concept.

What is claimed is:

1. A food keeping and serving assemblage comprising:

a base;

an insulating container mounted on said base, said container including cooling means;

an annular compartment surrounding said container and located adjacent to said insulating container;

a ring member mounted within said annular compartment;

a bearing assembly located within said ring and said annular compartment, said ring being freely rotatable relative to said base section and said insulating container;

a plurality of trays locatable within said annular compartment resting on said ring and rotatable therewith, each of said trays adapted to contain food accompaniments.

2. The confection keeping and serving assemblage in accordance with claim 1 wherein said insulating container is of double wall construction.

3. The food keeping and serving assemblage of claim 2 wherein each of said plurality of trays has a curvilinear rear wall congruently configured to the exterior of said insulating container.

4. A food keeping and serving assemblage comprising:

a base;

an insulating container of double wall construction mounted on said base, said container including cooling means;

an annular compartment surrounding said container and located adjacent to said insulating container;

a ring member mounted within said annular compartment;

a bearing assembly located within said ring and said annular compartment, said ring being freely rotatable relative to said base section and said insulating container;

plurality of trays locatable within said annular compartment resting on said ring and rotatable therewith, each of said trays adapted to contain food accompaniments and each having a curvilinear rear wall congruently configured to the exterior of said insulating container and each having an extending depending lip at the entrance of the opening thereof.

5. The food keeping and serving device of claim 4 wherein the bottom of each of said plurality of trays is configured to be received in mating relationship to the interior and exterior circumferential walls of said annular compartment.

6. The food keeping and serving device of claim 4 wherein it is primarily of molded plastic and said food is ice cream.

7. The food keeping and serving device in accordance with claim 6 which includes a cover for said insulating container.

8. The food keeping and serving device in accordance with claim 7 wherein said annular compartment is formed by a base member superpositioned to said bearing assembly.

9. The food keeping and serving device of claim 8 which additionally includes a ring member superpositioned over said annular compartment.

10. The food keeping and serving device in accordance with claim 9 wherein said container is of a size adapted to receive a conventional gallon size carton of ice cream.

11. A turntable ice cream keeping and serving appliance comprising:

a base;

an insulating container removably mounted on said base;

an annular compartment surrounding said insulating container and located adjacent to said insulating container;

a removable bearing assembly located within said annular compartment;

a plurality of removable trays each being locatable within said annular compartment, said removable trays being rotatable by said bearing assembly and each of said removable trays being adapted to contain ice cream fixings; and said insulating container being locatable on said base and adapted to keep ice cream therein over a period of time at and from which ice cream can be dispensed and served.

12. An ice cream keeping and serving lazy susan-like assemblage comprising:

a molded plastic annular base member having a central recess for receiving a container;

a molded plastic container of double walled construction adapted to keep ice cream therein and having a freezable substance within and between the double walls thereof and being configured for positioning within said central recess;

said molded plastic annular base member forming a central ring having depending walls from which are supported a plurality of removable trays each of said removable trays being locatable with and positioned in an abutting and mating relationship to said depending walls wherein said plurality of trays are compartmentalized and adapted to hold a plurality of ice cream fixings and toppings therein and a removable bearing assembly located beneath said molded plastic annular base member whereby the assemblage is freely rotatable in lazy susan fashion.

13. A food keeping and serving assemblage comprising:

a base;

an insulating container mounted on said base, said container including cooling means;

an annular compartment surrounding said container and located adjacent to said insulating container;

a ring member mounted within said annular compartment;

a bearing assembly located within said ring and said annular compartment, said ring being freely rotatable relative to said base section and said insulating container;

a plurality of trays locatable within said annular compartment resting on said ring and rotatable therewith, each of said trays adapted to contain food accompaniments and each having a curvilinear rear wall congruently configured to the exterior of said insulating container and each having an extended depending lip at the entrance of the opening thereof, said insulating container is adapted to receive a conventional ice cream carton therein and the inner wall of the upper most portion of said insulating container is inwardly directed to form a circumferential space between said insulating container and said ice cream carton whereby said ice cream carton is easily grasped for removal from said insulating container.

14. An ice cream keeping and serving assemblage primarily of molded plastic comprising:

a base;

an insulating container mounted on said base, a cover for said insulating container, said container being of a size to receive a conventional size carton of ice cream and including cooling means;

an annular compartment surrounding said container and located adjacent to said insulating container;

a ring member mounted within said annular compartment;

a bearing assembly located within said ring and said annular compartment, said ring being freely rotatable relative to said base section and said insulating container;

a plurality of trays locatable within said annular compartment resting on said ring and rotatable therewith, each of said trays adapted to contain food accompaniments, said annular compartment being formed by said base member being superpositioned to said bearing assembly, and a ring member being superpositioned over said annular compartment.

* * * * *